US009725147B2

(12) United States Patent
Ahn et al.

(10) Patent No.: US 9,725,147 B2
(45) Date of Patent: Aug. 8, 2017

(54) THRUSTER SYSTEM AND VESSEL INCLUDING THE SAME

(71) Applicant: Samsung Heavy Industries Co., LTD., Seoul (KR)

(72) Inventors: ChulSoo Ahn, Geoje (KR); SoonSeong Shin, Geoje (KR); Dae Kyung Kim, Geoje (KR); JaeChang Lee, Geoje (KR)

(73) Assignee: Samsung Heavy Industries Co., LTD., Seoul (KR)

( * ) Notice: Subject to any disclaimer, the term of this patent is extended or adjusted under 35 U.S.C. 154(b) by 0 days.

(21) Appl. No.: 14/360,967

(22) PCT Filed: Sep. 28, 2012

(86) PCT No.: PCT/KR2012/007892

§ 371 (c)(1),
(2) Date: May 28, 2014

(87) PCT Pub. No.: WO2013/081289

PCT Pub. Date: Jun. 6, 2013

(65) Prior Publication Data

US 2014/0341734 A1 Nov. 20, 2014

(30) Foreign Application Priority Data

Nov. 30, 2011 (KR) ..... 10-2011-0126616

(51) Int. Cl.

| | |
|---|---|
| ***B63H 5/125*** | (2006.01) |
| ***B63H 5/20*** | (2006.01) |
| ***B63H 25/42*** | (2006.01) |

(52) U.S. Cl.
CPC ..... *B63H 5/125* (2013.01); *B63H 25/42* (2013.01); *B63H 2025/425* (2013.01)

(58) Field of Classification Search
CPC ... B63H 5/125; B63H 25/42; B63H 2025/425
USPC ..... 440/38, 51, 53, 54
See application file for complete search history.

(56) References Cited

U.S. PATENT DOCUMENTS

| | | | | |
|---|---|---|---|---|
| 6,439,936 | B1 | 8/2002 | Dreith et al. | |
| 7,992,275 | B1 * | 8/2011 | Bekker | B63B 9/00 114/265 |

FOREIGN PATENT DOCUMENTS

| | | | |
|---|---|---|---|
| CN | 1997599 | A | 7/2007 |
| JP | 7019999 | Y2 | 3/1995 |
| JP | 2001-058599 | A | 3/2001 |
| JP | 2007-537036 | A | 12/2007 |
| KR | 10-2001-0108293 | A | 12/2001 |
| WO | 2010114380 | A1 | 10/2010 |

* cited by examiner

*Primary Examiner* — Anthony Wiest
(74) *Attorney, Agent, or Firm* — Patent Office of Dr. Chung Park

(57) ABSTRACT

Disclosed are a thruster system and a vessel including the same. The thruster system according to an exemplary embodiment of the present invention includes: a canister on which a thruster is installed, and which is movable upward and downward in a hull; a wire controller which controls a wire connected with the canister and enables the upward and downward movement of the canister; and a ballast tank which is installed in the canister and filled with water in order to offset the buoyancy that is applied to the canister.

13 Claims, 8 Drawing Sheets

THRUSTER SYSTEM AND VESSEL INCLUDING THE SAME

CROSS-REFERENCE TO PRIOR APPLICATIONS

This application is a national Stage Patent Application of PCT International Patent Application No. PCT/KR2012/007892, filed on Sep. 28, 2012 under 35 U.S.C. §371, which claims priority of Korean Patent Application No. 10-2011-0126616, filed on Nov. 30, 2011, which are all hereby incorporated by reference in their entirety.

TECHNICAL FIELD

The present invention relates to a thruster system and a vessel including the same, and more particularly, to a retractable thruster system and a vessel including the same.

BACKGROUND ART

The thruster system is used to adjust a position of a vessel, a marine structure, or the like, which floats on the water surface, and to control the vessel, the marine structure, or the like. The thruster system is mainly installed on a lower portion or in the interior of the vessel or the marine structure, and moves the vessel or the marine structure to a necessary position or maintains the current position of the vessel or the marine structure while being rotated in a lateral direction or in an arbitrary direction.

The thruster system may perform dynamic positioning that measures the current position and moves to a target position while compensating for disturbance such as tidal flows and waves, or may maintain the current position of the vessel or the marine structure in order to approach a harbor or the marine structure.

The thruster system may be classified into an omnidirectional thruster system and a tunnel type thruster system. The omnidirectional thruster system may control a position of the vessel or the marine structure through one or a plurality of thrust direction control operations. The tunnel type thruster system may implement lateral movement and rotation, thus having two types of degrees of freedom, and is mainly used to allow the vessel to approach a pier.

The thruster system is installed on a lower portion of a hull, and as a result, the thruster system protrudes from the lower portion of the hull. Therefore, the thruster system becomes a resistive body while the vessel sails, which causes deterioration in sailing efficiency of the vessel. In addition, since the installation of a thruster is mostly performed at the lower portion of the hull, work by a diver is necessarily required, and as a result, work for installing/dismantling the thruster is dangerous and complicated, and efficiency in installing/dismantling the thruster deteriorates. Furthermore, when the thruster system fails while the vessel sails, repairing the thruster system is complicated, and the thruster system protrudes from the lower portion of the vessel, which also makes it difficult to redock the vessel in order to repair the hull.

In order to solve the aforementioned problem, a retractable thruster system has been suggested. The retractable thruster system allows the thruster to protrude to the outside of the hull in a dynamic positioning mode (DP mode), and allows the thruster to retract into the hull while the vessel sails.

The retractable thruster system accommodates the thruster in a structure that is called a canister, and may move the canister up to a position for performing maintenance of the thruster.

The retractable thruster system moves the canister using a rack gear and a pinion gear, or moves the canister using a repetitive operation of a cylinder having a short stroke.

In a case in which the canister is moved by the rack gear and the pinion gear, a length of the rack gear needs to be greater than a stroke of the canister. Therefore, a length of the rack gear and a height of the canister may be increased. In a case in which a length of the rack gear is increased, evenness needs to be uniformly maintained, and as a result, there is a problem in that installation precision becomes higher.

In addition, in the case of the thruster system using the cylinder, a fixed position of the cylinder needs to be continuously changed in order to prevent an increase in length of the cylinder that lifts the canister, and as a result, there is a problem in that operations of installing and disassembling the cylinder need to be repeatedly performed.

In order to solve the aforementioned problems, a thruster system using a wire (Samsung Heavy Industries Co., Ltd.; Korean Patent Application No. 10-2011-0037188) has been suggested. In the case of the suggested thruster system, the upward movement of a canister is performed by tensile force that pulls the wire upward, and the downward movement of the canister is performed by a weight of the canister.

When the canister is moved downward from the water surface, buoyancy is applied to the canister, and as a result, a weight of the canister may be less than buoyancy. In this case, a reversed load occurs due to buoyancy, such that the canister connected to the wire may not be normally moved downward.

DISCLOSURE

Technical Problem

A thruster system and a vessel including the same according to an exemplary embodiment of the present invention are provided to offset buoyancy when a canister is moved downward.

Technical Solution

According to one aspect of the present invention, a thruster system including: a canister on which a thruster is installed, and which is movable upward and downward in a hull; a wire controller which controls a wire connected with the canister and enables the upward and downward movement of the canister; and a ballast tank which is installed in the canister and filled with water in order to offset the buoyancy that is applied to the canister may be provided.

The ballast tank may be installed in a height direction of the canister.

The ballast tank may include one or more holes through which water flows in or out.

The hole may be positioned to be adjacent to a bottom surface of the ballast tank.

The thruster system of the present invention may further include a filter which is installed in the hole.

The thruster system of the present invention may further include a pump which allows water to flow into or from the ballast tank.

The thruster system of the present invention may further include a first pipe which is connected with the pump and communicates with the outside of the canister, and a second pipe which is connected with the pump and communicates with the interior of the ballast tank.

The thruster system of the present invention may include a filter which is installed in any one or more of the first pipe and the second pipe.

The wire controller may include: an auxiliary drum which is fixed to the hull and changes a direction of the wire; a pulley which changes the direction of the wire; and a hydraulic cylinder which moves the pulley upward or downward.

The wire controller may include: an auxiliary drum which is fixed to the hull and changes a direction of the wire; a drum which winds the wire; and a motor which rotates the drum.

The canister may include a stopper pin which is installed on the canister so as to be inserted into a groove that is formed at a specific position of the hull.

The thruster system of the present invention may further include a guide roller which is installed on an inner surface of the hull or a side surface of the canister in order to stably support the upward and downward movement of the canister.

An amount of water stored in the ballast tank may be increased as the canister is moved downward from the water surface.

An amount of water stored in the ballast tank may be decreased as the canister is moved upward.

According to another aspect of the present invention, a vessel including the thruster system may be provided.

Advantageous Effects

The thruster system according to the exemplary embodiment of the present invention may offset buoyancy, which is applied to the canister, using the ballast tank.

BEST MODE

Figure 1:
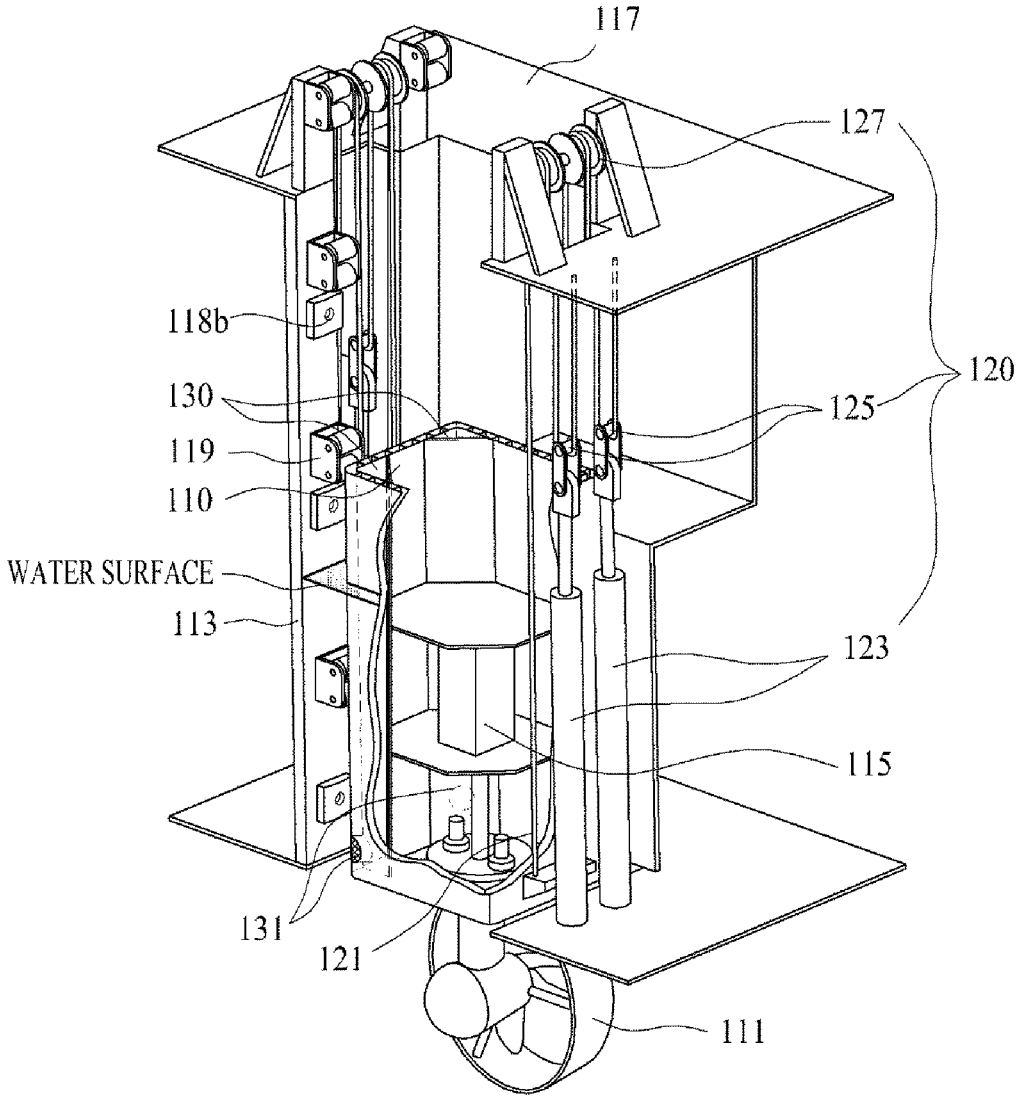
FIG. 1 illustrates a thruster system according to an exemplary embodiment of the present invention.

Hereinafter, preferred exemplary embodiments of the present invention by which objects of the present invention can be specifically implemented will be described with reference to the accompanying drawings. In the description of the present exemplary embodiments, the same terms and the same reference numerals are used to describe the same configurations, and additional descriptions thereof will be omitted.

FIG. 1 illustrates a thruster system according to an exemplary embodiment of the present invention. As illustrated in FIG. 1, a thruster system according to an exemplary embodiment of the present invention includes a canister 110, a wire controller 120, and a ballast tank 130.

A thruster 111 is installed on the canister 110, and the canister 110 is movable in a hull 113. When the thruster system is operated in a dynamic positioning mode (DP mode), the canister 110 may be moved downward so that the thruster 111 protrudes from a lower portion of the hull 113. When the thruster system is operated in a transit mode in order to allow a vessel or a marine structure to sail, the canister 110 is moved upward such that the thruster 111 may be moved into the hull 113. In addition, when it is necessary to perform maintenance to repair failure or the like of the thruster system, the canister 110 is further moved upward such that the thruster 111 may be completely exposed to the outside of the water surface.

The wire controller 120 controls a wire 121 connected with the canister 110 so as to enable the upward and downward movement of the canister 110. The wire controller 120 pulls or releases the wire 121 so as to allow the canister 110 connected with the wire 121 to be moved upward and downward. The wire controller 120 will be specifically described below with reference to the drawings.

The ballast tank 130 is installed in the canister 110, and cancels the buoyancy that is applied to the canister 110 when the canister 110 is moved downward from the water surface. In a case in which buoyancy is greater than gravity, which is applied to the canister 110, when the canister 110 is moved downward from the water surface as described above, tensile force is not applied to the wire 121, and as a result, it may be difficult for the canister 110 to be moved downward. In order to reduce the influence of buoyancy, sea water flows into the ballast tank 130 when the canister 110 is moved downward.

As illustrated in FIG. 1, a trunk 113, which is a part of the hull, may serve as a movement passage for lifting the canister 110. A drive motor 115 or the like, which operates the thruster 111, is installed in the canister 110.

One or more wire controllers 120 are installed between the trunk 113 and the canister 110. In FIG. 1, the wire controller 120 may include one or more hydraulic cylinders 123, pulleys 125, and auxiliary drums 127. The pulley 125 is installed at an end of a rod of the hydraulic cylinder 123.

One end of the wire 121 is fixed to a lower portion of a deck 117 that is installed on an upper portion of the trunk 113. The wire 121 is connected to a side end of the canister 110 through the pulley 125 via the auxiliary drum 127. Therefore, when the rod of the hydraulic cylinder 123 pulls the wire 121 while being moved downward, the canister 110 is moved upward, and when the rod of the hydraulic cylinder 123 is moved upward, the wire 121 is released, and the canister 110 is moved downward by gravity that is applied to the canister 110.

Because the hydraulic cylinder 123 has a structure in which a maximum load is applied when the rod is pulled, the hydraulic cylinder 123 is not affected by buckling, and a movement distance of the canister 110, which is twice as long as a stroke of the hydraulic cylinder 123, may be ensured by the pulley 125 at the end of the rod.

In order to ensure stability when the thruster 110 is moved upward or downward, a guide roller 119 is installed on a side surface of the trunk 113, and supports an outer surface of the canister 110. Unlike the exemplary embodiment of the present invention, the guide roller 119 may be installed on the outer surface of the canister 110, and may guide an inner surface of the trunk 113.

Figure 2:
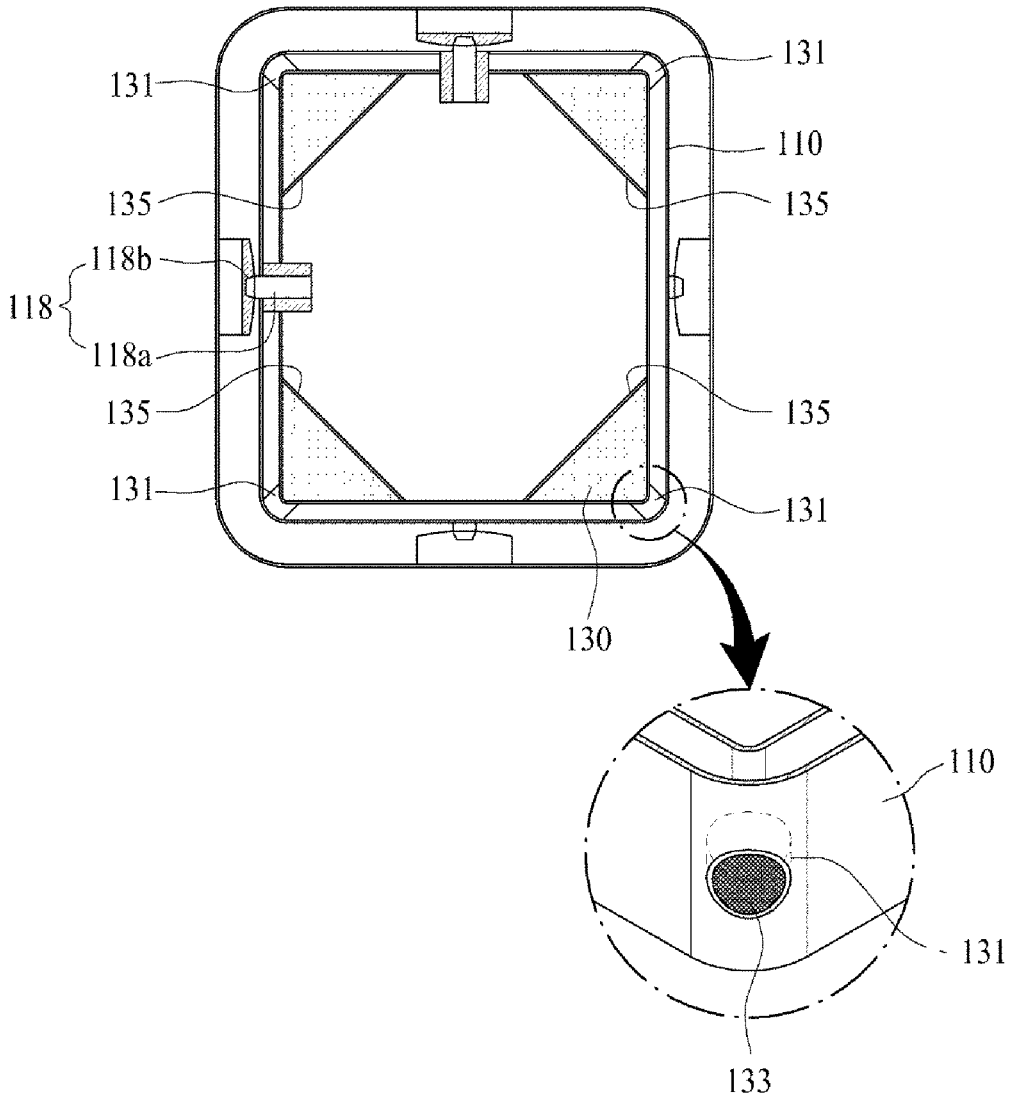
FIG. 2 illustrates a top plan view of a canister of the thruster system according to the exemplary embodiment of the present invention.

As illustrated in FIGS. 1 and 2, a stopper 118 may be installed in order to fix the canister 110 to a predetermined position. The stopper 118 may be installed at an arbitrary location of an outer end of the trunk 113, and may include a stopper pin 118*a*, and a groove 118*b*. When a limit sensor (not illustrated), which is installed on an upper portion of the canister 110, senses a stop position of the canister 110, the canister 110 is stopped, and the stopper pin 118*a* is moved forward by hydraulic pressure, and inserted into a structure such as the groove 118*b*. Therefore, the stopper pin 118*a* is fastened to the groove 118*b*.

The stoppers 118 may be installed at positions where the dynamic positioning mode, the transit mode, and the maintenance are performed, respectively, and as a result, the canister 110 may be fixed at heights that are required to perform the respective modes.

Figure 3:
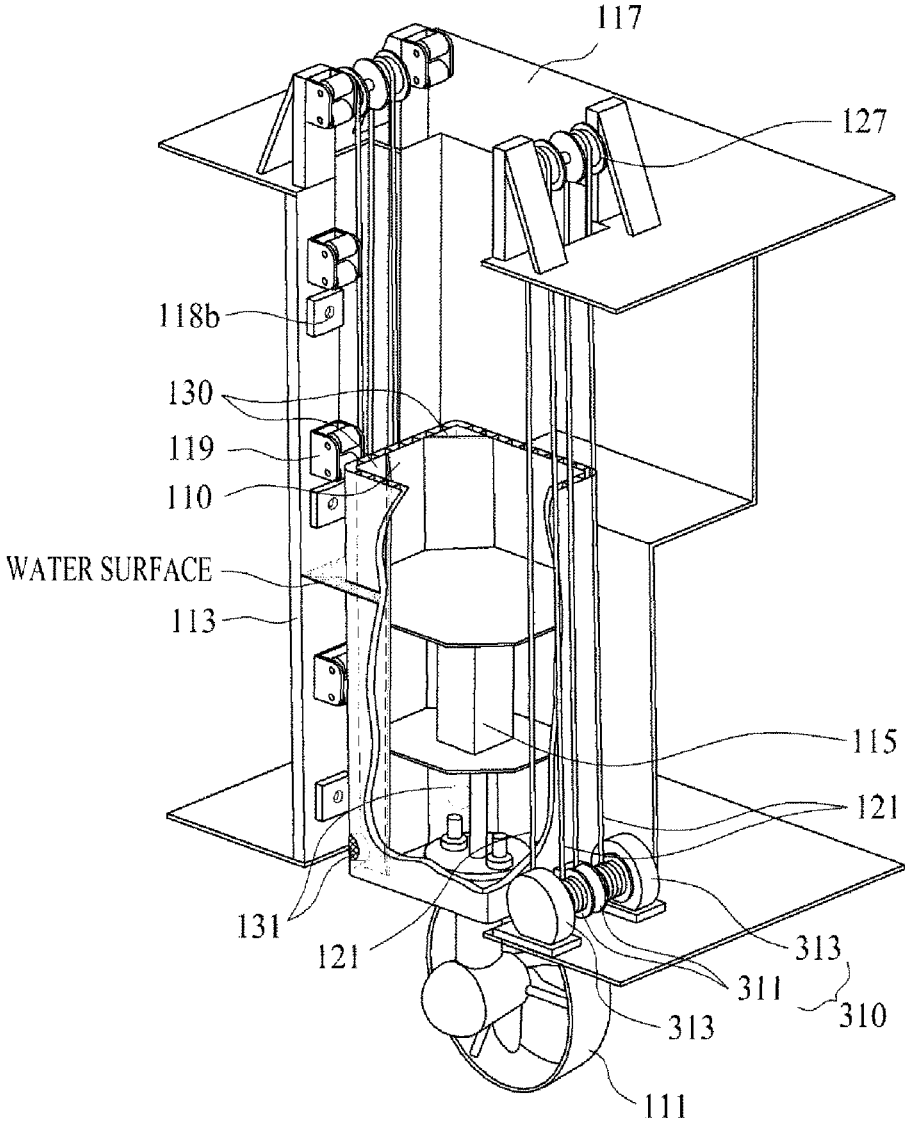
FIG. 3 illustrates another example of the thruster system according to the exemplary embodiment of the present invention.

In the previous description, the wire controller 120 includes the hydraulic cylinder 123 so as to control an operation of pulling the wire 121 or an operation of releasing the wire 121, but a winch system 310 of FIG. 3 may control an operation of pulling the wire 121 or an operation of releasing the wire 121 instead of the hydraulic cylinder 123 and the pulley 125. The winch system 310 winds the wire 121 around a cylindrical drum 311 so as to move the canister 110 upward or downward. A motor 313 rotates the drum 311.

In the case of the winch system 310, an operation of the motor 313 is controlled by a sensor (not illustrated) that senses an amount of wire 121 that is wound around the drum 311, and as a result, the canister 110 may be stopped at a stop position.

Meanwhile, as illustrated in FIGS. 1 to 3, the ballast tank 130 may have a space that may store water such as sea water, and the ballast tank 130 may be installed in a height direction of the canister 110. The ballast tank 130 may have partition walls 135 that partition spaces of the ballast tank 130 and an internal space of the canister 110.

In this case, the ballast tank 130 may have one or more holes 131 through which sea water flows in or out. In addition, the ballast tank 130 may include a mesh-shaped filter 133 that prevents an inflow of foreign substances such as sea grass when sea water flows in through the hole 131. To this end, the filter 133 may be installed in a region of the ballast tank 130 around the hole 131.

When the hole 131 of the ballast tank 130 is positioned below the water surface as the canister 110 is moved downward, water flows into the ballast tank 130 through the hole 131. Therefore, the ballast tank 130 is filled with water, and as a result, buoyancy, which is applied to the canister 110, is offset. In addition, when the canister 110 is moved upward, water in the ballast tank 130 flows to the outside through the hole 131 of the ballast tank 130.

Figure 4:
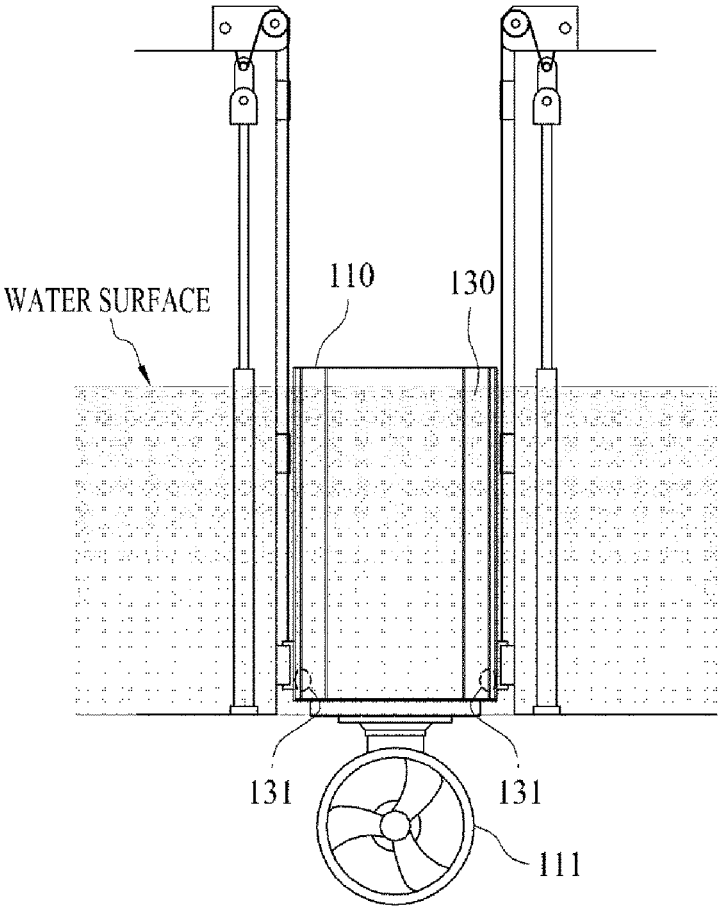
FIGS. 4 to 6 illustrate an operation of the thruster system according to the exemplary embodiment of the present invention.

That is, as illustrated in FIG. 4, when the thruster system is operated in the dynamic positioning mode (DP mode), the canister 110 is maximally moved downward such that the thruster 111 protrudes to the outside of the hull. As the canister 110 is moved downward, sea water flows into the ballast tank 130 through the hole 131 from a time point when the hole 131 of the ballast tank 130 is positioned below the water surface. As the canister 110 is moved downward, an amount of water, which is stored in the ballast tank 130, is increased. In addition, when the canister 110 is maximally moved downward, an amount of sea water, which flows into the ballast tank 130, also reaches a maximum level. Therefore, buoyancy, which is applied to the canister 110 being moved downward, is offset.

Figure 5:
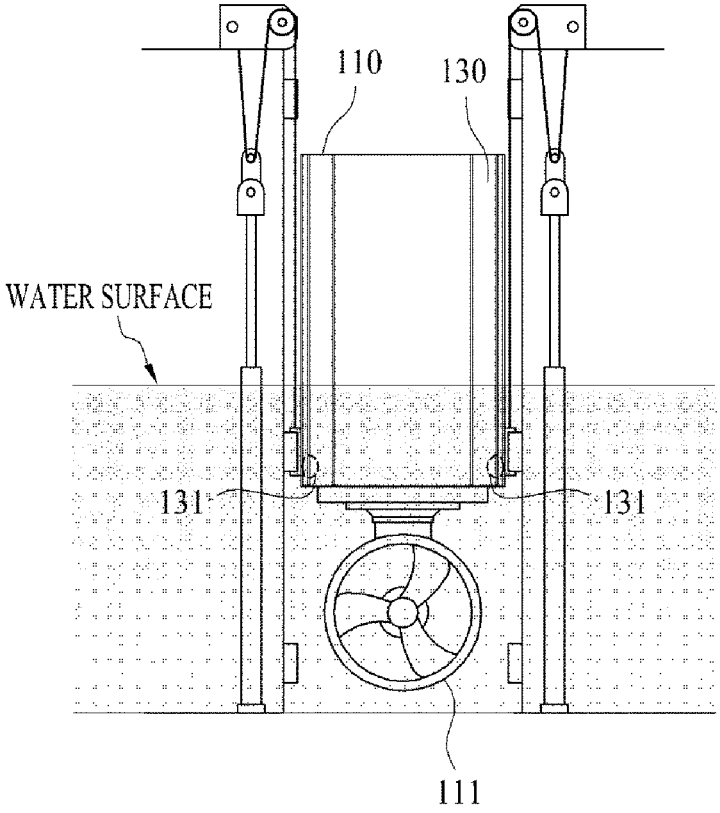

As illustrated in FIG. 5, when the thruster system is operated in the transit mode in order to allow a vessel or a marine structure to sail, the canister 110 is moved upward such that the thruster 111 may be moved into the hull 113. When the canister 110 begins to be moved upward, sea water in the ballast tank 130 begins to flow out through the hole 131. When the upward movement of the canister 110 is stopped, the ballast tank 130 is filled with sea water up to a height of the sea water surface.

Figure 6:
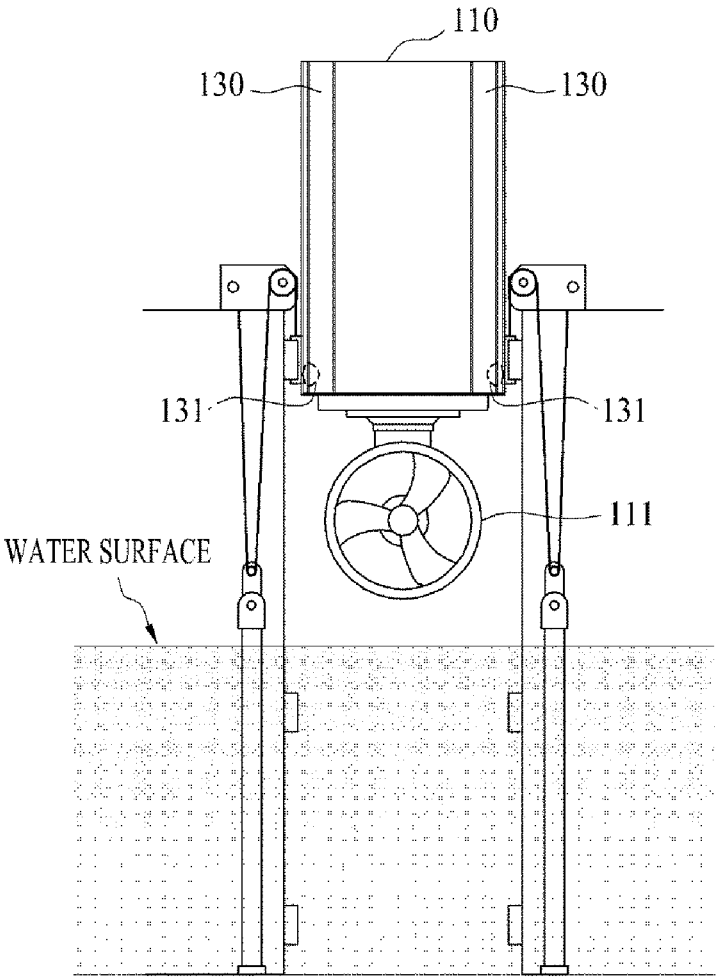

As illustrated in FIG. 6, in a case in which the canister 110 is moved upward up to a maximum height for the purpose of maintenance of the thruster 111, the thruster 111 and the canister 110 are moved upward from the sea water surface. Therefore, the hole 131 is positioned at a position higher than the sea water surface, and an amount of sea water in the ballast tank 130 reaches a minimum level.

That is, as can be seen from FIGS. 4 and 5, as the canister 110 is moved upward, an amount of water stored in the ballast tank 130 may be decreased.

Since the space of the ballast tank 130 is formed in a height direction as described above, an amount of sea water stored in the ballast tank 130 may be varied depending on a height at which the canister 110 is moved upward.

The configuration in which sea water flows in or out through the hole 131 of the ballast tank 130 has been described above. However, sea water may flow into or from the ballast tank 130 through the hole 131, but sea water may flow into or from the ballast tank 130 by a pump.

Figure 7:
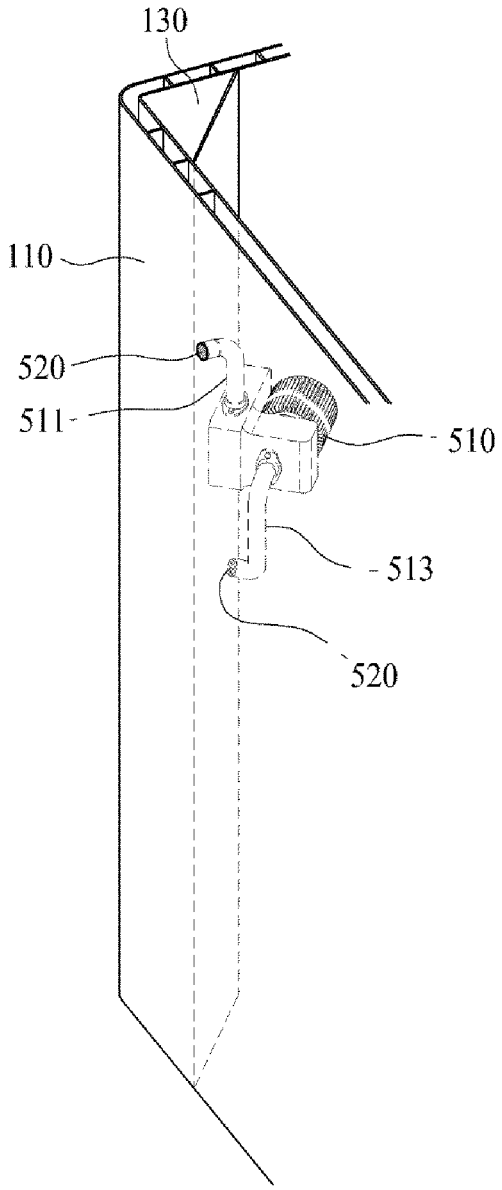
FIG. 7 illustrates a thruster system according to another exemplary embodiment of the present invention.

That is, as illustrated in FIG. 7, a thruster system according to another exemplary embodiment of the present invention may include a pump 510. The pump 510 may forcedly allow sea water to flow into the ballast tank 130. To this end, one pipe 511 of pipes 511 and 513 connected with the pump 510 communicates with the outside of the canister 110, and the other pipe 513 communicates with the interior of the ballast tank 130.

When the thruster system is operated in the dynamic positioning mode, the pump 510 sucks sea water outside the canister 110 into the ballast tank 130 as the canister 110 is moved downward. Therefore, since gravity, which is applied to the canister 110, is increased due to water in the ballast tank 130, buoyancy, which occurs when the canister 110 is moved downward from the water surface, may be offset.

When the thruster system is operated in the transit mode, or when maintenance of the thruster system is performed, the pump 510 allows sea water in the ballast tank 130 to flow to the outside of the canister 110 as the canister 110 is moved upward. Therefore, as water in the ballast tank 130 flows out, gravity, which is applied to the canister 110, is decreased, and as a result, the canister 110 may be smoothly moved upward.

Another exemplary embodiment of the present invention may also further include a filter 520 that filters foreign substances from water that is sucked by the pump 510. The filter 520 may be installed in the pipe 511 that communicates with the outside of the canister 110, or may be installed in the pipe 520 that communicates with the ballast tank 130.

Figure 8:
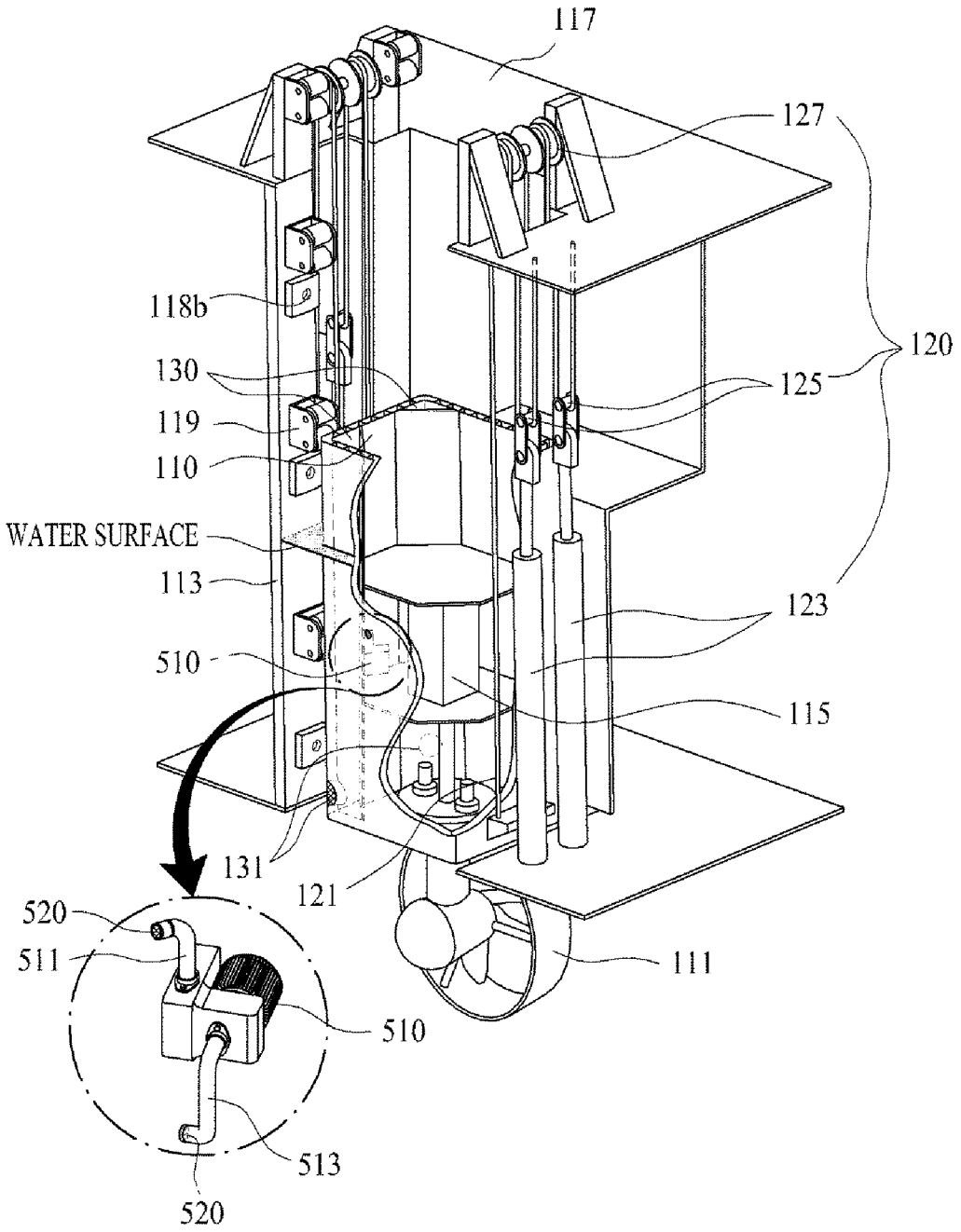
FIG. 8 illustrates a thruster system according to yet another exemplary embodiment of the present invention.

As illustrated in FIG. 8, a thruster system according to yet another exemplary embodiment of the present invention may include a ballast tank 130 having holes 131, and a pump 510. That is, as the canister 110 is moved downward, external sea water may naturally flow into the ballast tank 130 through the hole 131, and the pump 510 forcedly allows external sea water to flow into the ballast tank 130. Therefore, a large amount of sea water may quickly flow into the ballast tank 130, and as a result, buoyancy may also be smoothly offset.

Meanwhile, in a case in which the hole 131 is positioned in a middle region of the ballast tank 130, sea water does not flow into the ballast tank 130 until the hole 131 reaches the position of the sea water surface after the canister 110 is moved downward from the water surface. In order to prevent the delay in the inflow of sea water, the hole 131 of the ballast tank 130 may be positioned to be adjacent to a bottom surface of the ballast tank 130. Therefore, when the canister 110 begins to be moved downward from the water surface, sea water may quickly flow in through the hole 131.

While the preferred exemplary embodiments according to the present invention have been described above, it is obvious to those skilled in the art that in addition to the aforementioned exemplary embodiments, the present invention may be implemented as other specific forms without departing from the purpose and the scope of the present invention. Accordingly, the aforementioned exemplary embodiments should be only illustrative and not restrictive for this invention, and thus, the present invention is not limited to the aforementioned description, but may be modified within the scope of the appended claims and equivalents thereto.

The invention claimed is:

1. A thruster system comprising:

a canister on which a thruster is installed, and which is movable upward and downward in a hull along a first direction;

a wire controller which controls a wire connected with the canister and enables a movement of the canister along the first direction; and a partition wall which partitions a corner space of the canister to define a ballast tank, the ballast tank extends along the first direction and has a same dimension as the canister in the first direction, wherein the canister is moved along a trunk which is a part of the hull at each of a dynamic positioning mode in order to move a vessel or a marine structure, a transit mode in order to allow the vessel or the marine structure to sail, and a respective mode in order to do maintenance of the thruster and an amount of water filled in the ballast tank changes as the canister is moved relative to the water surface along the first direction to thereby offset a buoyancy applied to the canister.

2. The thruster system of claim 1, wherein the ballast tank includes one or more holes through which water flows in or out.

3. The thruster system of claim 2, wherein the hole is positioned to be adjacent to a bottom surface of the ballast tank.

4. The thruster system of claim 2, further comprising: a filter which is installed in the hole.

5. The thruster system of claim 1, further comprising: a pump which allows water to flow into or from the ballast tank.

6. The thruster system of claim 5, further comprising: a first pipe which is connected with the pump and communicates with the outside of the canister, and a second pipe which is connected with the pump and communicates with an interior of the ballast tank.

7. The thruster system of claim 6, further comprising: a filter which is installed in any one or more of the first pipe and the second pipe.

8. The thruster system of claim 1, wherein the wire controller includes: an auxiliary drum which is fixed to the hull and changes a direction of the wire; a pulley which changes the direction of the wire; and a hydraulic cylinder which moves the pulley upward or downward.

9. The thruster system of claim 1, wherein the wire controller includes: an auxiliary drum which is fixed to the hull and changes a direction of the wire; a drum which winds the wire; and a motor which rotates the drum.

10. The thruster system of claim 1, wherein the canister includes a stopper pin which is installed on the canister so as to be inserted into a groove that is formed at a specific position of the hull.

11. The thruster system of claim 1, further comprising: a guide roller which is installed on an inner surface of the hull or a side surface of the canister in order to stably support the movement of the canister.

12. A vessel comprising the thruster system which comprises a canister on which a thruster is installed, and which is movable upward and downward in a hull along a first direction; a wire controller which controls a wire connected with the canister and enables a movement of the canister; and a partition wall which partitions a corner space of the canister to define a ballast tank, the ballast tank extends along the first direction and has a same dimension as the canister in the first direction, wherein the canister is moved along a trunk which is a part of the hull at each of a dynamic positioning mode in order to move a vessel or a marine structure, a transit mode in order to allow the vessel or the marine structure to sail, and a respective mode in order to do maintenance of the thruster, and an amount of water filled in the ballast tank changes as the canister is moved relative to the water surface along the first direction to thereby offset a buoyancy applied to the canister.

13. A thruster system comprising:

a canister on which a thruster is installed, and which is movable upward and downward in a hull along a first direction;

a wire controller which controls a wire connected with the canister and enables a movement of the canister along the first direction; and a first partition wall which partitions one corner space of the canister to define a first ballast tank and a second partition wall which partitions another corner space of the canister to define a second ballast tank, each of the first ballast tank and the second ballast tank extends along the first direction and has a same dimension as the canister in the first direction, wherein an amount of water filled in the ballast tank changes as the canister is moved relative to the water surface along the first direction to thereby offset a buoyancy applied to the canister.

* * * * *